US011345979B2

(12) United States Patent
Sidorov et al.

(10) Patent No.: US 11,345,979 B2
(45) Date of Patent: May 31, 2022

(54) METHOD OF CASTING ARTICLES FROM ALUMINUM ALLOYS

(71) Applicant: OBSHCHESTVO S OGRANICHENNOY OTVETSTVENNOST'YU "OBEDINENNAYA KOMPANIYA RUSAL INZHENERNO-TEKHNOLOGICHESKIY TSENTR", Krasnoyarsk (RU)

(72) Inventors: Aleksandr Yur'evich Sidorov, Krasnoyarsk (RU); Viktor Fedorovich Frolov, Krasnoyarsk (RU); Igor' Vladimirovich Kostin, Krasnoyarsk (RU); Andrej Viktorovich Danilov, Krasnoyarsk (RU); Aleksandr Yur'evich Krokhin, Krasnoyarsk (RU); Sergej Vladimirovich Belyaev, Krasnoyarsk (RU); Aleksandr Innokent'evich Bezrukikh, Krasnoyarsk (RU)

(73) Assignee: OBSHCHESTVO S OGRANICHENNOY OTVETSTVENNOST'YU "OBEDINENNAYA KOMPANIYA RUSAL INZHENERNO-TEKHNOLOGICHESKIY TSENTR", Krasnoyarsk (RU)

( * ) Notice: Subject to any disclaimer, the term of this patent is extended or adjusted under 35 U.S.C. 154(b) by 102 days.

(21) Appl. No.: 16/463,352

(22) PCT Filed: Oct. 4, 2017

(86) PCT No.: PCT/RU2017/000740
§ 371 (c)(1),
(2) Date: May 22, 2019

(87) PCT Pub. No.: WO2018/097753
PCT Pub. Date: May 31, 2018

(65) Prior Publication Data

US 2019/0316227 A1 Oct. 17, 2019

(30) Foreign Application Priority Data

Nov. 24, 2016 (RU) ..... RU2016146204

(51) Int. Cl.
*C22C 1/03* (2006.01)
*B22D 21/00* (2006.01)
*C22C 21/00* (2006.01)

(52) U.S. Cl.
CPC ..... *C22C 1/03* (2013.01); *B22D 21/007* (2013.01); *C22C 21/00* (2013.01)

(58) Field of Classification Search
CPC ..... C22C 1/03; B22D 21/007
(Continued)

(56) References Cited

U.S. PATENT DOCUMENTS 6,004,506 A 12/1999 Chu et al.
6,454,832 B1 9/2002 Verdier et al.

FOREIGN PATENT DOCUMENTS

CN 102943193 A * 2/2013
RU 2443793 C1 2/2012
(Continued)

OTHER PUBLICATIONS

International Search Report and Written Opinion of PCT/RU2017/000740 by the International Searching Authority (ISA/RU), dated Jan. 31, 2018. (Original Russian and English translation).

*Primary Examiner* — Weiping Zhu
(74) *Attorney, Agent, or Firm* — Baker & McKenzie LLP

(57) ABSTRACT

The invention relates to the field of aluminum metallurgy and can be used to produce ingots from high quality aluminum alloys when manufacturing aerospace and automotive products. The use of this invention relates to the technology of secondary modification. The method of casting products from aluminum alloys includes the following stages: a)
(Continued)

Figure 1:
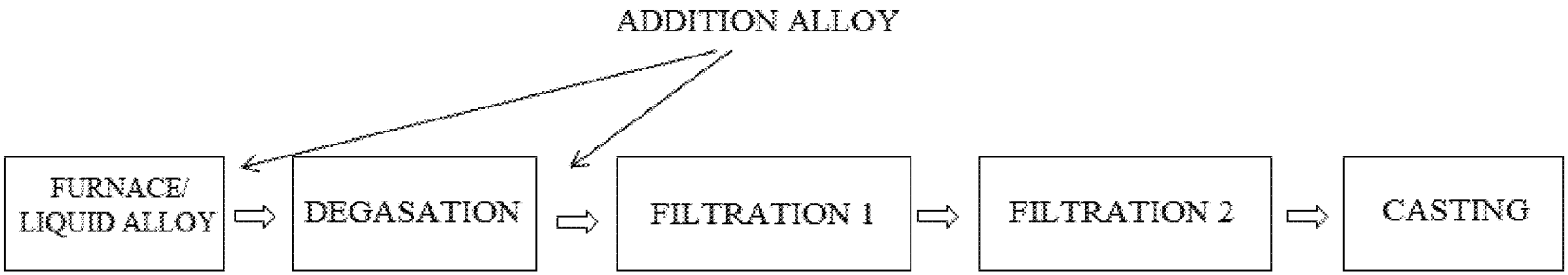

aluminum melt preparation in the alloying furnace; b) addition alloy introduction into melt; c) degassing of the aluminum melt containing the addition alloy; d) addition alloy re-introduction; e) filtration of the aluminum melt obtained at stage d) and f) feeding the filtered melt into the crystallizer. It ensures the improved effectiveness of the aluminum melt modification with addition alloys without additional constructional changes in existing lines for aluminum ingot casting. It allows reducing the alloy modification costs, decreasing the grain in resulting alloys and improving plastic and mechanical properties of the obtained cast ingots and their products.

13 Claims, 3 Drawing Sheets

(58) Field of Classification Search
USPC ..... 420/552
See application file for complete search history.

(56) References Cited

FOREIGN PATENT DOCUMENTS

| | | | | |
|---|---|---|---|---|
| RU | 2486269 | C2 | 6/2013 | |
| WO | WO-2013018165 | A1 * | 2/2013 | ..... B22D 11/0622 |

* cited by examiner

VARIANT №1

VARIANT №2

VARIANT №3

VARIANT 1.1

VARIANT 1.2

METHOD OF CASTING ARTICLES FROM ALUMINUM ALLOYS

CROSS-REFERENCE TO RELATED APPLICATIONS

This application is a U.S. National Stage entry of and claims priority to PCT Application No. PCT/RU2017/000740 filed Oct. 4, 2017, which itself claims priority to Russian Patent Application No. RU2016146204A filed Nov. 24, 2016. The contents from all of the above are hereby incorporated in their entirety by reference.

FIELD OF INVENTION

The invention relates to the field of aluminum metallurgy and can be used to produce ingots from high quality aluminum alloys when manufacturing aerospace and automotive products. The use of this invention relates to the ladle modification technology.

BACKGROUND OF THE INVENTION

The problem of improving mechanical and operational properties of the products, which are made of aluminum alloys, is still relevant in the foundry production theory and practice. Today, there are various methods of influence on the alloy structure. Currently, the most accessible and widespread method is the modification, namely, grinding grains of finished aluminum ingots due to the introduction of seeding modifiers. Among the modifiers, the most common are modifying addition alloys that contain refractory dispersed particles, which are potential crystallization centers. Their introduction into the molten metal changes the crystallization process that makes it possible to obtain a fine and uniform structure, thereby improving technological properties of the alloy. Thus, the addition alloy quality and modifying ability affect the quality of the products that are obtained by casting aluminum alloys, which determines high requirements for addition alloys, such as the absence of non-metallic inclusions, the ability to be completely dissolved and evenly distributed in the melt, etc. In terms of the invention background, the main part of researches and technical decisions is aimed at improving the addition alloy quality, while there is no clear data on the methods of the addition alloy introduction for the purpose of achieving its maximum modifying effect when administered during the aluminum casting.

There is also a method for producing ingots from aluminum alloys, which includes feeding the molten metal from the alloying furnace to the crystallizer through the casting box, which contains at least one source of ultrasound and a casting chute; additionally, after filling the casting box with a melt, the source of ultrasound is lowered into the melt, and a modifying rod with transition metals or their compounds is introduced under the ultrasound source. (Patent RU 2486269, C22C1/03, C22C221/04, published on Jun. 27, 2013). The disadvantage of this method is that technologically the implementation of multi-crystal casting and the modification efficiency improvement require a high volume casting box with the installation of an additional number of ultrasound sources, which entails the additional constructional changes in the existing casting lines and the increase in their cost.

The other known method is casting ingots of aluminum alloys with the semi-continuous method using addition alloys, degassing units, filtering (Patent U.S. Pat. No. 6,004, 506A, C22C 1/02, C22C 21/00, published on Dec. 21, 1999). The invention reveals the introduction of alloying elements into the aluminum alloy during casting into the crystallizer by means of supplementing addition alloy directly into the molten aluminum for obtaining increased characteristics of the ingot. However, an obvious disadvantage of the method is that the addition alloy is not exposed to filtration; it is fed directly to the crystallizer, which can lead to the ingress of oxide scabs, non-metallic inclusions, and insoluble particles of the addition alloy with the risk of the unsatisfactory quality of the addition alloy.

The article "Modeling the Al—Ti—B addition alloy distribution process, depending on the flow rate and the rod input scheme during casting flat ingots" by I. V. Kostin, A. A. Ilin, N. V. Gromov, S. V. Belyaev, A. I. Bezrukikh—Prospekt Svobodnyi—2016 International Conference for students, postgraduates and young scientists presents the results of studies on the quality of aluminum ingots obtained using the semi-continuous method of aluminum casting in two schemes: the addition alloy introduction before the metal filter and the addition alloy introduction before the degassing unit.

The addition alloy introduction before filters is a well-known practice used in the foundry production; nevertheless, it is common knowledge that the maximum modifying effect of the introduced addition alloy requires the particles whose size is in the range from 2 μm to 5 μm. Using the mentioned method of introducing the addition alloy, particles of the dissolved modifier can agglomerate and settle down on the filters. As a result, not all nucleating particles in the addition alloy reach the crystallizer and function as a modifier in the ingot; the melt filtration degree decreases as well.

In order to remove the mentioned disadvantage, the article offers to introduce the addition alloy before the degassing unit. The proposed method of the addition alloy introduction made it possible to achieve smaller grain (160 μm) in flat ingots compared to the introduction of the addition alloy before the filter (240 μm). However, the disadvantage of the method is that for achieving that grain size, the flow rate of the addition alloy had to be significantly increased. Probably, this can be explained by the fact that, on the one hand, non-metallic inclusions and oxide scabs in the addition alloy are removed during the degassing process and the agglomerates of modifying particles $TiB_2$ are broken down and their greater number passes into the melt. Nevertheless, due to the intensive mixing process and gas flushing some part of the addition alloy is lost, which requires introducing more addition alloy to replenish the modifying particles lost. The mentioned method is selected as a prototype in this application.

DISCLOSURE OF THE INVENTION

The object of the invention is to develop a method for casting products from aluminum alloys, which allows obtaining alloys with a smaller grain and improved plastic and mechanical properties.

The technical result is the increased efficiency of the aluminum melt modification with the addition alloy without any additional constructional changes in the existing aluminum ingot casting lines to reduce the alloy modification costs, and the decreased amount of grain in finished alloys together with improved plastic and mechanical properties of the cast ingots and the products made of such ingots.

The technical result is achieved due to the fact that the method of casting products from aluminum alloys includes the following stages:

a) Aluminum melt preparation in the alloying furnace;
b) Introducing Al—Ti—B addition alloy into the melt;
c) Degassing of the aluminum melt containing the addition alloy;
d) Re-introduction of the addition alloy;
e) Filtration of the aluminum melt obtained at stage d), and
f) Feeding the filtered melt into the crystallizer, and the ratio of the addition alloy supplied amount at stage b) and stage d) is from 1:1 to 9:1.

According to one of the proposed invention variants, the filtration of the molten metal is performed in two stages.

In this case, the re-introduction of the addition alloy at stage d) is performed before the first stage of filtration or before the second stage of filtration.

According to one of the invention variants, the re-introduction of the addition alloy at stage d) is performed in two stages—before the first stage of filtration and before the second stage of filtration.

According to one of the invention variants, the filtration system that allows filtering out impurities up to 5-9 μm—a refining unit with a system of filter cartridges—is used at the first stage of filtration.

According to one of the invention variants, a coarse filter is used at the second stage of filtration; in this case, the coarse filter may consist of a filter box with several filter elements that allow filtering out impurities up to 70 μm in size. The ceramic foam filter can be used as a coarse filter.

According to one of the invention variants, strand addition alloy is used as the addition alloy.

One of the preferred variants of the invention is the use of AlTiB 5/1 alloying strand as the addition alloy in the places of the addition alloy supply at the melt temperature 690-700° C. and the flow rate of the molten metal from the alloying furnace to the crystallizer 10-16 cm/s and the amount of the supplied addition alloy at stage b) and stage d) in ratio 2:1.

IMPLEMENTATION OF THE INVENTION

The molten aluminum from the alloying furnace is fed into the crystallizer through a system of casting troughs. A degassing unit, a fine filter and a coarse filter, namely a ceramic foam filter are built into the system of troughs. The melt is prepared in the alloying furnace as follows: the aluminum raw material coming from the pot room is poured into the furnace, and then the melt is alloyed and refined. After the melt preparation it is fed through the system of troughs, including degassing and filtration stages, to the crystallizers, where semi-continuous casting of flat ingots was performed.

At the first stage, the melt undergoes a degassing stage. Degassing is carried out by feeding a certain amount of inert gas (for example, argon) to a system of rotating impellers; upward bubble flows in the melt are created under the influence of centrifugal force. The melt is saturated with bubbles. The intensive stirring of the melt occurs in the degassing unit; at the same time, oxides, non-metallic contaminants, hydrogen and other harmful impurities are removed from the melt by means of "grasping" them with gas bubbles and migrating to the slag.

Then, the melt enters the first stage of filtration, which is a refining unit with a system of filter cartridges. The aluminum melt passes through the cartridges with a porous branched morphology; as a result, all impurities up to 5-9 μm are filtered out.

At the third stage, the melt is fed into the coarse filter (the second stage of filtration) consisting of a filter box with several filter elements, which additionally purify the melt from unwanted particles up to 70 μm in size. Those particles can enter the melt after the fine filter, for example, during sampling, making measurements, violation of the lining integrity or technological process failure.

Temperature control of the molten metal was carried out using thermocouples. The molten metal temperature in places of the alloying rod supply was 690-700° C.

Practical experience shows that during the process of multi-crystal casting the rate of feeding the molten metal from the alloying furnace to the crystallizer should be 10-16 cm/s to ensure the more intense melting of the addition alloy.

The alloying rod with the known AlTiB 5/1 composition in volume of 3 kg/t was used as the addition alloy.

According to the first (variant 1) variant, the addition alloy was fed in two stages—the addition alloy was fed before the degassing stage and before the first stage of filtration in the ratio of 2:1. (FIG. 1)

Figure 2:
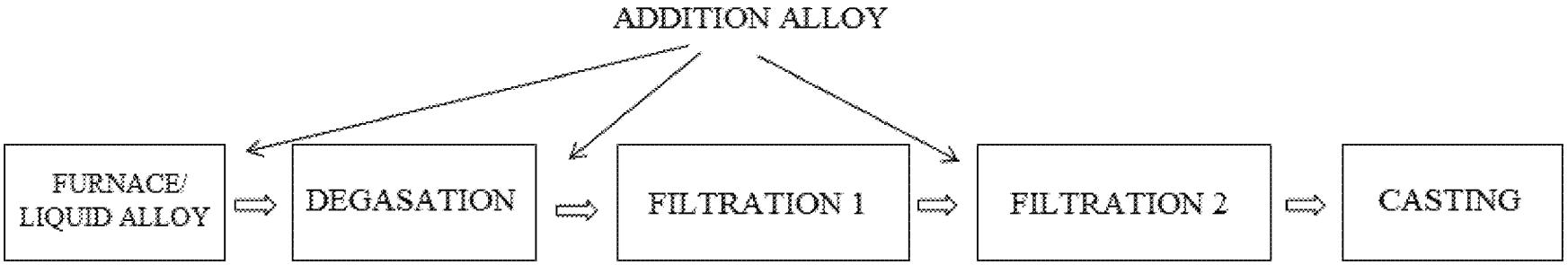

According to the second variant (variant 2), the addition alloy was fed before degassing in a distributed manner, before the first filtration stage and before the second filtration stage in the ratio of 3:1:1 (FIG. 2)

Figure 3:
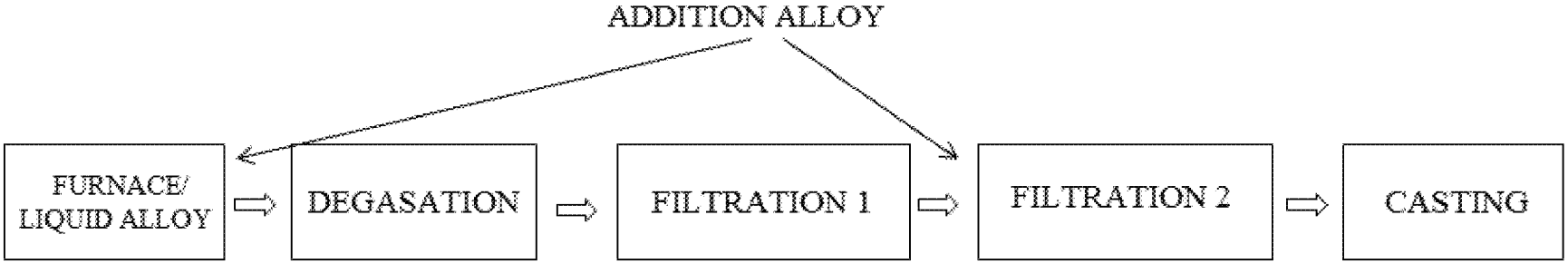

According to the third variant (variant 3), part of the addition alloy was fed before degassing, and the rest of it was fed after the first filtration stage and before the second filtration stage (FIG. 3).

Figure 4:
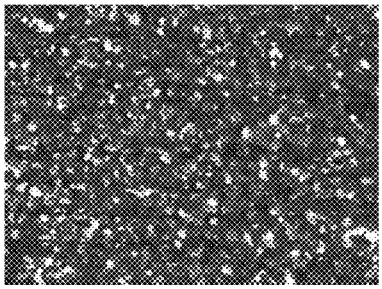
Figure 4:
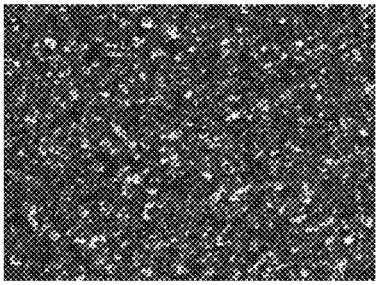
Figure 4:
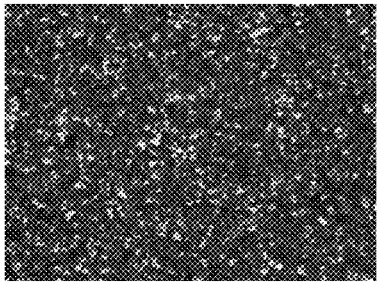

The grain size of finished ingots was evaluated on the template selected from the middle of the ingot using a microscope. The macrostructures of the ingot templates, which were obtained with the use of the methods described in the mentioned variants, are presented in FIG. 4. The evaluation results are shown in Table 1.

TABLE 1

| Method of feeding addition alloy | Grain size of the obtained ingot, μm |
|---|---|
| Prototype | 160 |
| Variant 1 | 112 |
| Variant 2 | 122 |
| Variant 3 | 140 |

It can be seen from the table that the smallest grain (112 μm) is typical for the ingot obtained by the method according to variant 1, namely, when the addition alloy is fed in two stages—some part of the addition alloy is fed before degassing and the remaining part of the total amount of the addition alloy, introduced in the casting process, is fed before the first filtration stage.

Moreover, the addition alloy was additionally fed according to variant 1, at the same time changing the ratio of the amount of the addition alloy that was fed at the first stage and at the second stage: with ratio of 1:1 (Variant 1.1) and ratio of 1:9 (Variant 1.2).

Figure 5:
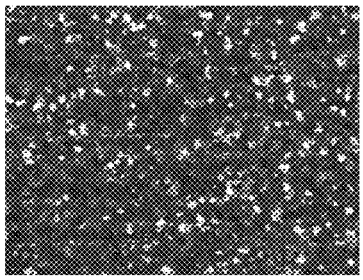
Figure 5:
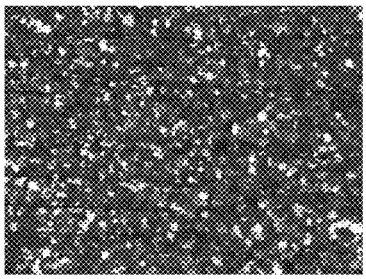

The size of the finished ingot grain was evaluated on the template selected from the middle of the ingot using a microscope. The macrostructures of the ingot templates, which were obtained using the methods described in the mentioned variants, are presented in FIG. 5. The evaluation results are shown in Table 2.

TABLE 2

| Method of feeding addition alloy | Grain size of the obtained ingot, μm |
|---|---|
| Variant 1.1 | 128 |
| Variant 1.2 | 150 |

Based on the results of the study presented in Table 1 and Table 2, it can be concluded that the claimed method helps achieve the more effective dissolution of the addition alloy, since its part is fed before the degasser, which allows to intensify the addition alloy melting process, reduce the size of the agglomerates, remove oxide scabs and non-metallic inclusions in the addition alloy, which hereinafter allows the particles to pass through the filter elements of the casting line more freely.

However, as a result of the studies it was unexpectedly found that the maximum effect of the addition alloy introduction is observed in cases of two-stage introduction—before the degassing stage and before the filtration stage.

When introducing some part of the addition alloy before the degassing stage and the second part before filtration at ratio of 1:9, grain grinding is observed compared to the prototype, as well as significant grinding (more than 2 times) comparing to the grain obtained with the introduction of the whole amount of the addition alloy before the filtration stage. Besides, the achieved effect is observed in various variants of introducing the second part of the addition alloy both before the first filtration stage, and when its second part is fed before the second stage of filtration, or before two filtration stages in case of two-stage filtration.

In addition, it was unexpectedly found that the effect of decreasing the grain is stable with the same amount of the introduced addition alloy with all the stated variants of the addition alloy introduction into the melt. Even with the introduction of the larger part of the addition alloy before the degassing stage, there is no need to compensate its loss in the degassing process by means of increasing the total amount of the introduced addition alloy to decrease the grain size in the finished product.

Thus, with the same amount of the addition alloy introduced into the melt using the claimed method, the technological plasticity of ingots increases and the level of mechanical properties of deformed semi-finished products increases to much greater extent than in case of the prototype.

What is claimed is:

1. The method of casting products from aluminum alloys that includes the following stages a) Aluminum melt preparation in the alloying furnace;

b) Al—Ti—B addition alloy introduction into the melt;

c) Degassing of the aluminum melt with the addition alloy;

d) Addition alloy re-introduction;

e) Filtration of the aluminum melt obtained at stage d), wherein the molten metal filtration is carried out in two stages, and f) Feeding the filtered melt into the crystallizer, where the ratio of the addition alloy supplied amount at stage b) and stage d) is from 1:1 to 9:1, and the flow rate of the molten metal from the alloying furnace to the crystallizer is 10-16 cm/s.

2. The method according to claim 1 characterized in that the re-introduction of the addition alloy at stage d) is carried out before the first filtration stage.

3. The method according to claim 1 characterized in that the re-introduction of the addition alloy at stage d) is carried out before the second filtration stage.

4. The method according to claim 1, characterized in that the re-introduction of the addition alloy at stage d) is carried out in two stages—before the first filtration stage and before the second filtration stage.

5. The method according to any of claims 1 and 2-4 differs in that the first filtration stage uses the filtration system, which allows filtering out contaminations up to 5-9 μm in size.

6. The method according to any of claims 1 and 2-4 differs in that the first stage of filtration uses the refining unit with the system of filter cartridges.

7. The method according to any of claims 1 and 2-4 differs in that the second stage of filtration uses the coarse filter.

8. The method according to claim 7 characterized in that the coarse filter consists of the filter box with several filter elements, allowing to filter out contaminations up to 70 μm in size.

9. The method according to claim 8 characterized in that the ceramic foam filter is used.

10. The method according to claim 1 differs in that the strand addition alloy is used as the addition alloy.

11. The method according to claim 1 differs in that the AlTiB alloying rod is used as the addition alloy.

12. The method according to claim 11 characterized in that the melt temperature in the places of the addition alloy feed is 690-699° C.

13. The method according to claim 1 differs in that the amount of the addition alloy fed at stage b) and stage d) is in ratio of 2:1.

* * * * *